US006879776B1

(12) United States Patent
Wu

(10) Patent No.: US 6,879,776 B1
(45) Date of Patent: Apr. 12, 2005

(54) STEAM CLEANER HAVING COOLING AIR PASSAGE

(76) Inventor: Lian Bao Wu, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/822,458

(22) Filed: Apr. 9, 2004

(51) Int. Cl.[7] ..... A61H 33/12
(52) U.S. Cl. ..... 392/405; 392/386
(58) Field of Search ..... 392/405, 404, 392/386, 400, 401

(56) References Cited

U.S. PATENT DOCUMENTS 2,726,314 A * 12/1955 Prain ..... 126/271.1
5,265,318 A * 11/1993 Shero ..... 29/447
6,536,379 B1 * 3/2003 Liu ..... 122/379

* cited by examiner

*Primary Examiner*—Thor Campbell

(57) ABSTRACT

A steam cleaner includes a container having a chamber to receive a steam generator, and a housing having a space to receive a portion of the container and having one or more spacers extended into the space and engaged with the container, to form an air passage between the container and the housing. The housing includes a number of apertures for allowing air to flow through the air passage and to cool the housing. The container includes a front tube to receive an outlet port of the steam generator. A nozzle may be detachably attached to the container. An extension shank may be detachably attached to the rear portion of the container.

1 Claim, 5 Drawing Sheets

STEAM CLEANER HAVING COOLING AIR PASSAGE

BACKGROUND OF THE INVENTION

1. Field of the Invention

The present invention relates to a steam cleaner, and more particularly to a steam cleaner having a passage for allowing cooling air to flow into the steam cleaner and to cool the steam cleaner without additional fan devices.

2. Description of the Prior Art

Various kinds of typical steam cleaners have been developed and comprise a steam generator to generate steam or vapor for cleaning or cleansing purposes. For generating the steam or the vapor, a heater or heating device is required to heat and to evaporate the water.

However, the housing of the steam cleaners to receive the steam generator may also be heated by the heater or heating device and/or by the steam, such that an additional fan device is further required to be provided and attached to the housing, in order to generate or to circulate air and to cool the housing of the steam cleaners.

The housings of the steam cleaners are thus required to have a great volume formed or provided therein to receive both the steam generator and the fan device, such that the steam cleaners may include a greater weight and/or volume that is adverse for storing and transportation purposes.

The present invention has arisen to mitigate and/or obviate the afore-described disadvantages of the conventional steam cleaner facilities.

SUMMARY OF THE INVENTION

The primary objective of the present invention is to provide a steam cleaner including an air passage for allowing cooling air to flow into the steam cleaner and to cool the steam cleaner without additional fan devices.

The other objective of the present invention is to provide a steam cleaner including one or more nozzles selectively or changeably attached to the front portion of the steam cleaner and to conduct different cleaning operations.

The further objective of the present invention is to provide a steam cleaner including an extension shank selectively or changeably attached to the rear portion of the steam cleaner and to allow the steam cleaner to clean higher or farther positions or areas.

In accordance with one aspect of the invention, there is provided a steam cleaner comprising a container including a chamber formed therein, a steam generator received in the chamber of the container for generating steam, and a housing including a space formed therein to receive a portion of the container, and including at least one spacer extended into the space thereof, to engage with the container, and to form an air passage between the container and the housing, and the housing including a number of apertures formed therein for air circulating purposes.

The container includes a lower casing and an upper casing disposed in the chamber of the container to receive the steam generator in the lower and the upper casings. The container includes a front portion having a tube provided therein, and having an opening formed in the tube, the steam generator includes an outlet port received in the opening of the tube.

A nozzle may further be provided and detachably attached to the front portion of the container for outwardly supplying the steam. The container includes a tube provided in the front portion thereof, and having an opening formed in the tube, the nozzle includes a pipe extended rearwardly therefrom and selectively engageable into the opening of the tube of the container. The tube of the container includes a lock notch formed therein, the pipe of the nozzle includes a spring blade having a catch 43 extended therefrom and engageable into the lock notch of the tube, and to detachably lock the pipe of the nozzle to the tube of the container.

An extension shank may further be provided and detachably attached to the rear portion of the container. The container includes a handle provided in the rear portion thereof, the extension shank is selectively engageable into the handle of the container. The handle of the container includes a hole formed therein, the extension shank includes a spring biased latch engageable into the hole of the handle, and to detachably lock the extension shank to the handle of the container.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
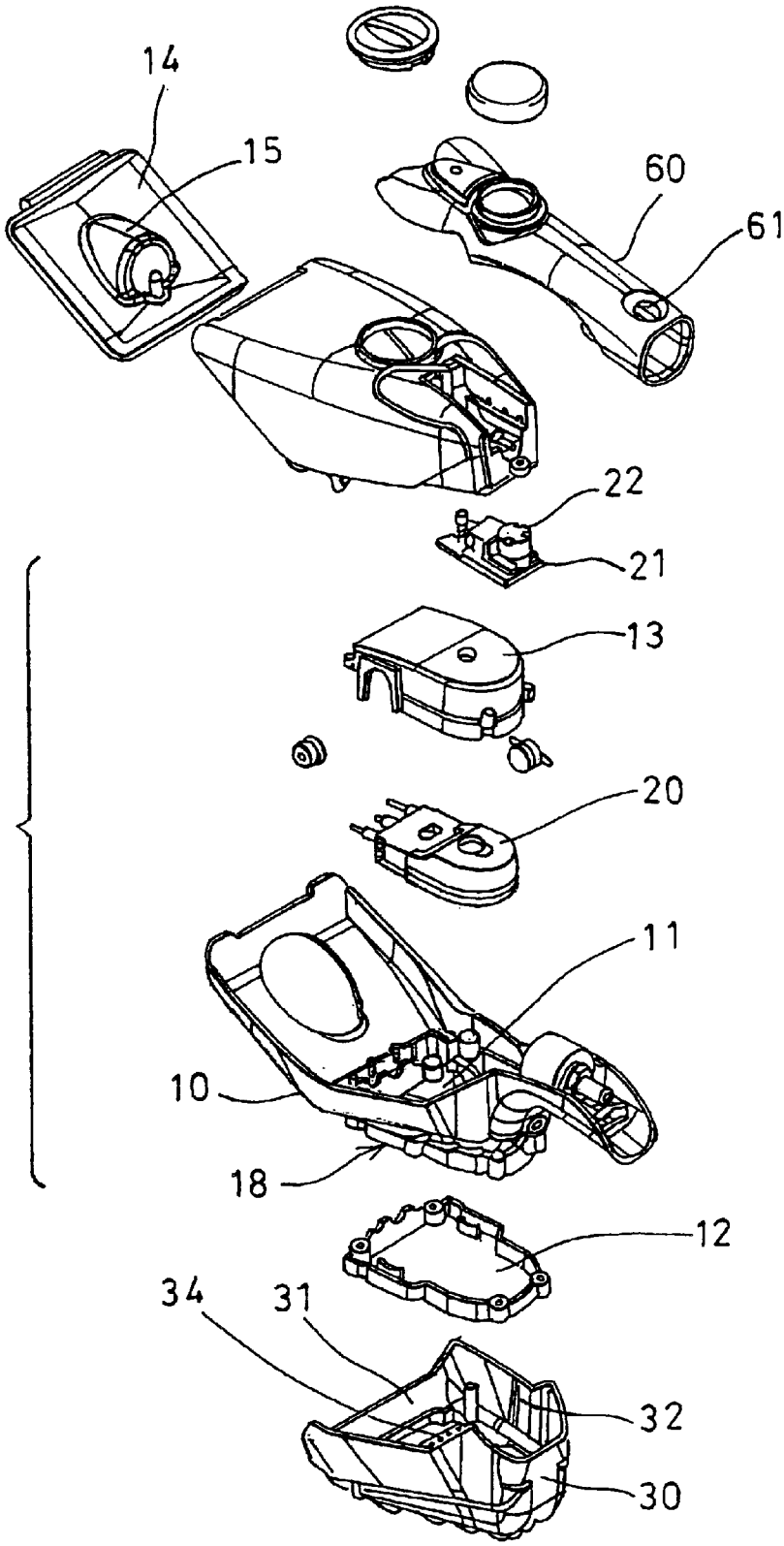
FIG. 1 is an exploded view of a steam cleaner in accordance with the present invention.

Referring to the drawings, and initially to FIGS. 1–4, a steam cleaner in accordance with the present invention comprises a container 10 including a chamber 11 formed therein to receive a lower casing 12 and an upper casing 13, and a steam generator 20 received in the casings 12, 13.

Since the steam generator 20 may generate a great heat, it is preferable that the casings 12, 13 are made of heat endurable materials and/or heat conductive materials, such as steel, or the like, for preventing the casings 12, 13 from being damaged by heat, and for allowing heat to be dissipated from the casings 12, 13.

A circuit board 21 and/or a control device 22 may further be provided and disposed in the container 10 (FIGS. 1, 2), and coupled to the steam generator 20, to control or to actuate the steam generator 20 to generate steam which may be supplied out of the container 10 via an outlet port 23 of the steam generator 20 (FIGS. 2 and 4–6), for such as cleaning purposes.

The container 10 includes a front portion 14 having a tube 15 formed or provided therein, and having an opening 16 formed therein to receive and to shield or to protect the outlet port 23 of the steam generator 20, and to prevent the outlet port 23 of the steam generator 20 from being exposed, and thus to prevent users from being hurt by the outlet port 23 of the steam generator 20.

Figure 4:
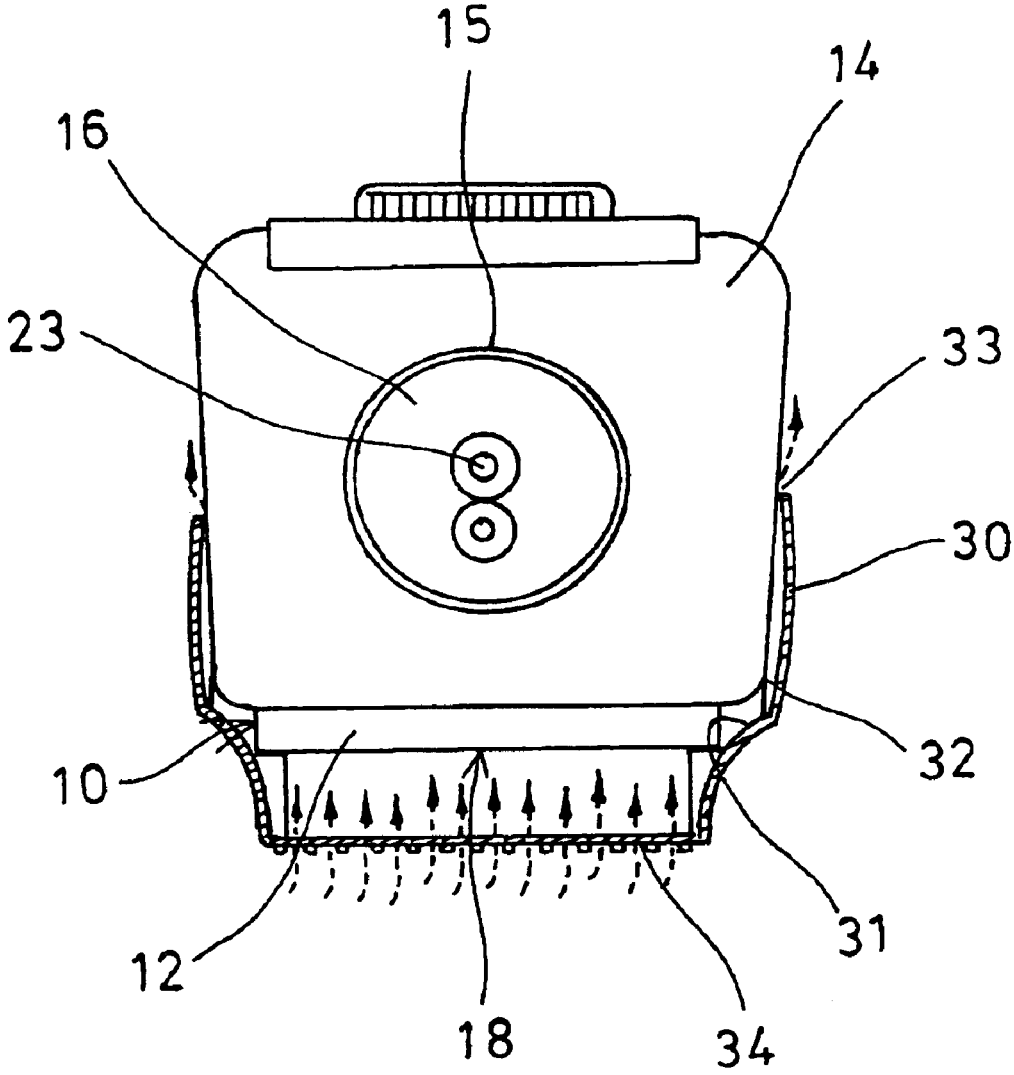
FIG. 4 is a front schematic view of the steam cleaner.

A holder or housing 30 may further be provided and includes a space 31 formed therein to receive a lower portion 18 of the container 10, and includes one or more ribs or spacers 32 extended into the space 31 thereof, to engage with the container 10, and to form or define a gap or an air passage 33 between the container 10 and the housing 30 (FIG. 4).

The housing 30 further includes a number of apertures 34 formed therein for air circulating purposes. In operation, when the steam generator 20 is heated to generate steam, the casings 12, 13 may also be heated, and heated air may flow upwardly through the air passage 33 formed or defined between the container 10 and the housing 30, and may flow out of the container 10. The air passage 33 and the apertures 34 of the housing 30 may be provided for both air circulating or cooling purposes and water draining purposes.

In addition, when the heated air flows out of the container 10, the air in the environment may also be drawn into the housing 30 via the apertures 34 of the housing 30, to suitably cool the casings 12, 13 and/or the steam generator 20, and to prevent the container 10 from being over heated. The casings 12, 13 and/or the steam generator 20 may thus be suitably cooled down by circulating air without additional fan devices.

Figure 6:
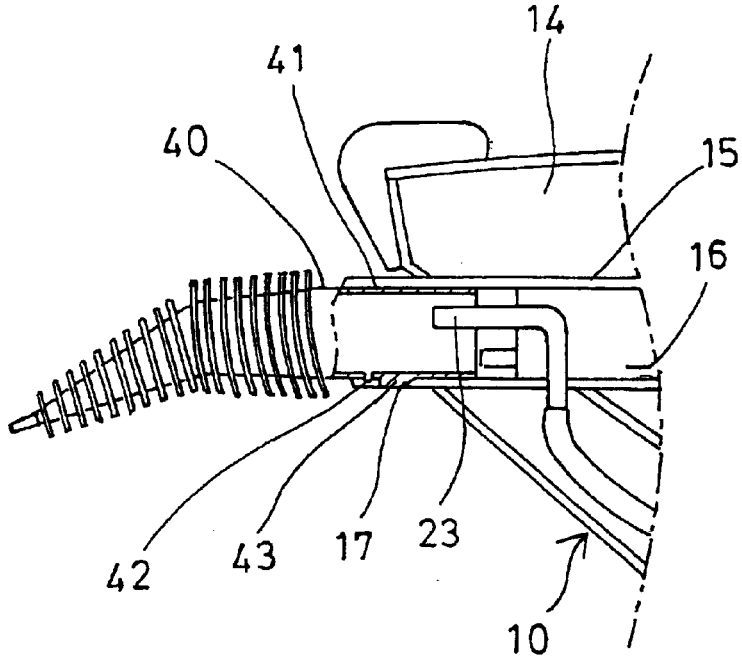
FIG. 6 is a partial cross sectional view illustrating the attachment of the nozzle to the steam cleaner.
Figure 5:
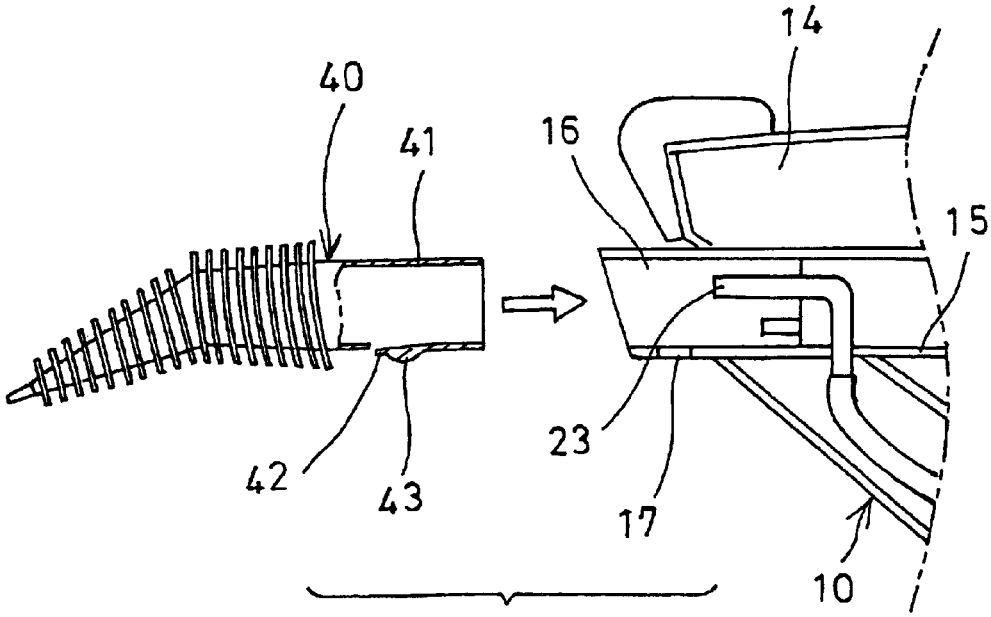
FIG. 5 is a partial exploded and cross sectional view illustrating an attachment of a nozzle to the steam cleaner.

Referring next to FIGS. 5 and 6, a nozzle 40 includes a pipe 41 extended rearwardly therefrom and selectively engageable into the opening 16 of the tube 15 of the container 10. The pipe 41 includes a spring blade 42 having a catch 43 extended therefrom for engaging into a lock notch 17 of the tube 15, and thus to detachably lock the pipe 41 of the nozzle 40 to the tube 15 of the container 10.

The other nozzles (not shown) may also be selectively or changeably attached to the tube 15 of the container 10 with the spring biased catch 43. The conventional steam cleaners fail to provide other nozzles that may be selectively or changeably attached to the tube 15 of the container 10, to conduct different cleaning operations.

Figure 2:
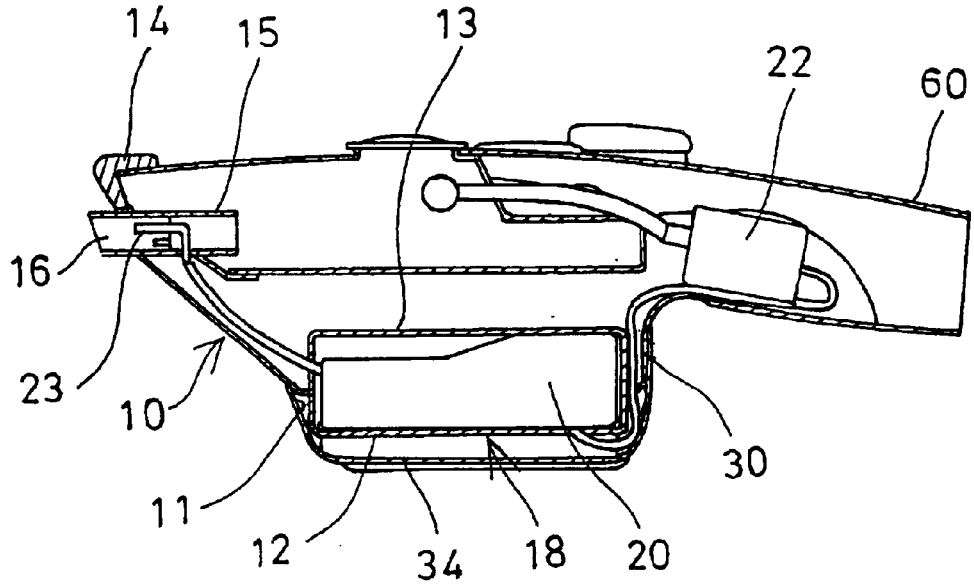
FIG. 2 is a partial cross sectional view of the steam cleaner.
Figure 3:
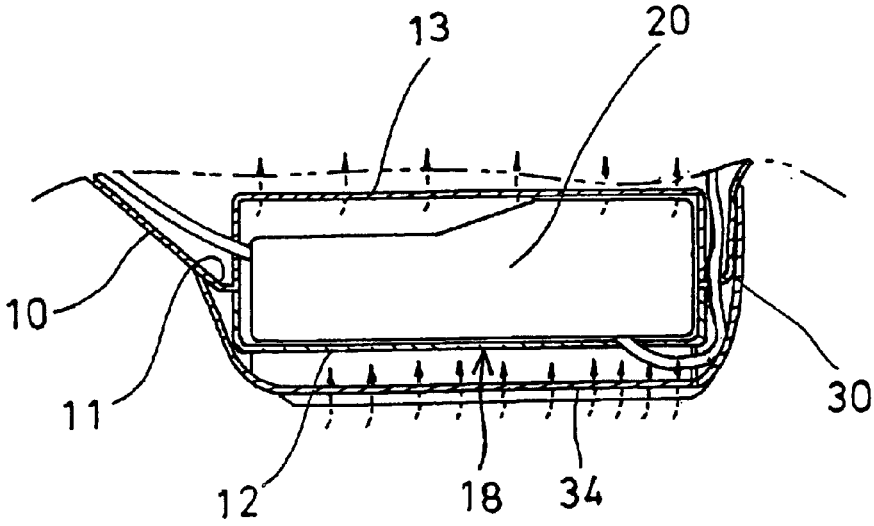
FIG. 3 is an enlarged partial cross sectional view of the steam cleaner.
Figure 7:
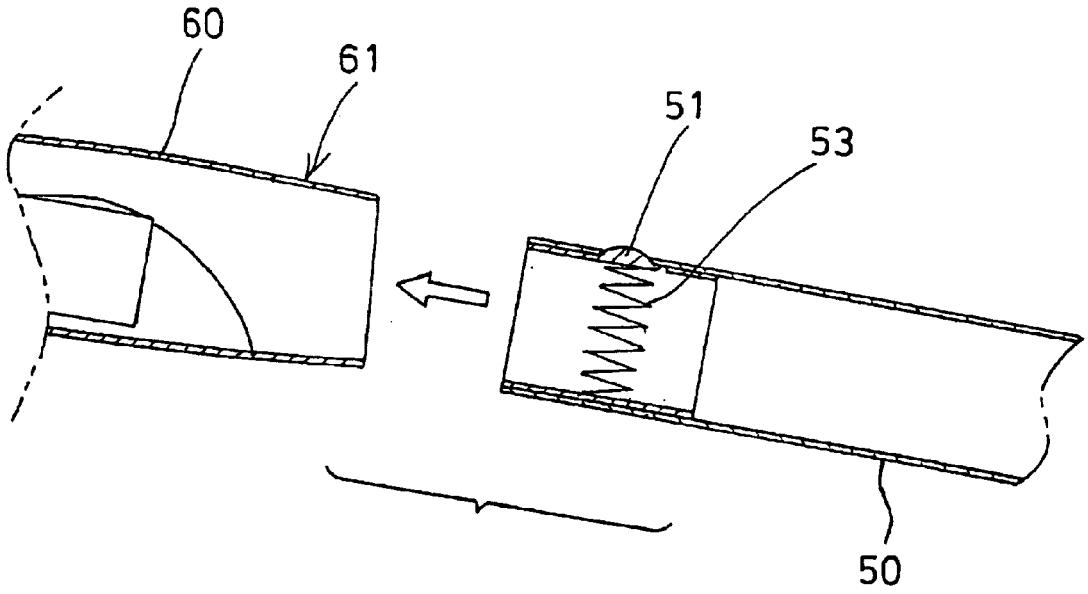
FIG. 7 is a partial exploded and cross sectional view illustrating an attachment of an extension shank to the steam cleaner.
Figure 8:
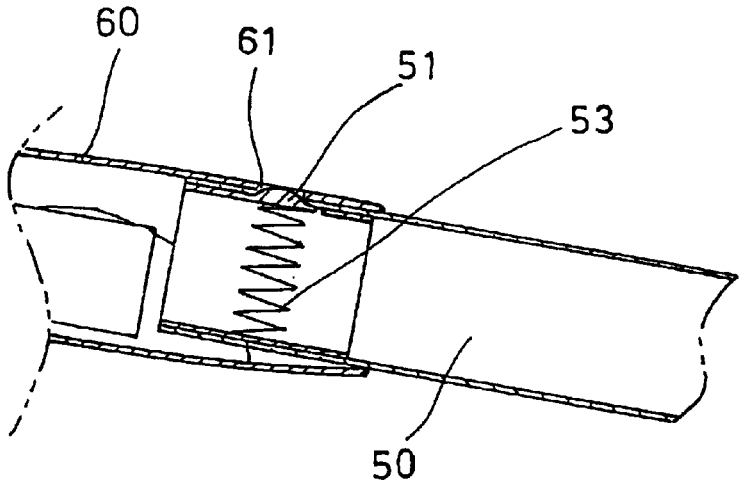
FIG. 8 is a partial cross sectional view illustrating the attachment of the extension shank to the steam cleaner.

Referring next to FIGS. 7 and 8, and again to FIGS. 1 and 2, an extension shank 50 may further be provided and engageable into a handle 60 of the container 10. The extension shank 50 may include a latch 51 biased by a spring member 53, to engage into a hole 61 of the handle 60, and thus to detachably lock the extension shank 50 to the handle 60 of the container 10.

The other extension shanks (not shown) may also be selectively or changeably attached to the handle 60 of the container 10 with the spring biased latch 51. The conventional steam cleaners fail to provide other extension shanks that may be selectively or changeably attached to the handle 60 of the container 10, to allow the steam cleaner to clean higher or farther positions or areas.

Accordingly, the steam cleaner in accordance with the present invention includes an air passage for allowing cooling air to flow into the steam cleaner and to cool the steam cleaner without additional fan devices.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A steam cleaner comprising:

a container including a chamber formed therein, and including a front portion and a rear portion, said container including a tube and a lower casing and an upper casing disposed in said front portion thereof, and including an opening and a lock notch formed in said tube, said container including a handle provided in said rear portion thereof and having a hole formed therein, a nozzle detachably attached to said front portion of said container for outwardly supplying the steam, said nozzle including a pipe extended rearwardly therefrom and selectively engageable into said opening of said tube of said container, said pipe of said nozzle including a spring blade having a catch extended therefrom and engageable into said lock notch of said tube, and to detachably lock said pipe of said nozzle to said tube of said container, an extension shank selectively engageable into said handle of said container and thus detachably attached to said rear portion of said container, said extension shank including a spring biased latch engageable into said hole of said handle, to detachably lock said extension shank to said handle of said container, a steam generator received in said chamber of said container for generating steam, and received in said lower casing and said upper casing of said container, and including an outlet port received in said opening of said tube, and a housing including a space formed therein to receive a portion of said container, and including at least one spacer extended into said space thereof, to engage with said container, and to form an air passage between said container and said housing, and said housing including a plurality of apertures formed therein for air circulating purposes.

* * * * *